US005277331A

United States Patent [19]

Barbaccia

[11] Patent Number: 5,277,331

[45] Date of Patent: Jan. 11, 1994

[54] VENDING MACHINE FOR DISPENSING SPHERICAL OBJECTS

[76] Inventor: Louis P. Barbaccia, 541 Santa Rosa Ave., Los Gatos, Calif. 95032

[21] Appl. No.: 981,261

[22] Filed: Nov. 25, 1992

[51] Int. Cl.[5] ..... B65B 59/00

[52] U.S. Cl. ..... 221/15; 221/68; 221/93; 221/277; 221/266; 221/281

[58] Field of Search ..... 273/201; 194/219, 242; 221/15, 68, 277, 263, 266, 281, 93, 95, 123, 131

[56] References Cited

U.S. PATENT DOCUMENTS

| | | | |
|---|---|---|---|
| 2,479,878 | 8/1949 | Strelzoff | 221/68 |
| 3,360,163 | 12/1967 | Fessler | 221/277 |
| 4,347,860 | 9/1982 | Hayashi et al. | 194/219 |
| 4,588,108 | 5/1986 | Knez et al. | 221/68 |
| 4,712,712 | 12/1987 | Garden | 221/68 |

*Primary Examiner*—H. Grant Skaggs
*Attorney, Agent, or Firm*—Robert Charles Hill

[57] ABSTRACT

An apparatus for vending spherical objects such as golf balls including a housing from which the balls are loaded onto the upper end of an inclined row of parallel tracks thereby forming a column of balls in each track. A rotatable horizontal shaft is located adjacent to the lower end of the tracks. Tines are secured to the shaft such that, as the shaft rotates, the lowermost ball in each column is scooped up successively by the tines and deposited in a chute leading to a bucket. The tines are located in staggered positions on the shaft so that the number of balls discharged into the bucket depends on the length of time that the shaft rotates. A buyer may select his/her desired number of balls by inserting coins into slots that activate one of a number of timers having various time periods.

11 Claims, 2 Drawing Sheets

VENDING MACHINE FOR DISPENSING SPHERICAL OBJECTS

FIELD OF THE INVENTION

This invention relates to vending machines for dispensing spherical objects and more particularly to a device that dispenses a number of balls selectable by the user.

BACKGROUND OF THE INVENTION

Machines for vending balls have been disclosed such as described in U.S. Pat. No. 4,588,108 to Knez et al which is hereby incorporated as reference in this specification. Knez discloses an apparatus for discharging a fixed number of golf balls, having an inclined floor of tracks formed by a number of parallel rods extending in the direction of inclination. The distance between the rods is less than the diameter of the golf balls so that the rods form parallel tracks on which a number of balls are positioned. A lower section of the floor of tracks pivots on an axis parallel to the lower edge of the floor such as to separate the lowest ball on each track located on the lower pivoting track section from the column of balls on the upper end of the track. The balls on the lower pivoting section of the tracks are retained in an L-shaped bar which rotates about an axis that extends along the corner of the L shaped bar, the pivoting floor section and L-shaped bar forming a cradle for directing the lower row of balls into the chute while the cradle is rotating. An arch surface attached to the L shaped bar maintains the upper column of balls on the track while L shaped bar is rotating to discharge the lowest ball.

The Knez patent also shows an elongated brush that helps to align the balls on the tracks prior to their entry, one row of balls at a time, into the cradle.

The pivoting cradle empties a row of balls into a chute that directs the balls into a bucket.

SUMMARY OF THE INVENTION

One problem with the Knez apparatus is that the balls in the cradle are all dumped by the cradle simultaneously into the chute which directs the balls into the bucket. Therefore a practical limit is placed on the number of balls that can discharged at once since a large number of balls discharged simultaneously can become jammed in the chute or spill out of the bucket.

Another problem with the Knez apparatus is that it will deliver only a fixed number of balls determined by the length of the L-shaped bar and number of tracks feeding balls to the cradle. However there has been found to be a need to be able to dispense from a single vending apparatus any one of several quantities of balls depending on the desire of the user. In practice, the user should be able to select the desired quantity of balls by simply inserting the appropriate amount of money into the vending apparatus.

Accordingly, there is contemplated a ball vending apparatus including a floor of straight tracks, all parallel to one another and inclined toward a lower end of the floor. An elongated brush has an outer surface formed by ends of brush bristles. The long dimension of the brush is horizontally oriented perpendicular to the direction of incline and spaced from the tracks so as to align the balls and maintain a column of balls in each track so that, as one ball is discharged at the lower end of the track, another ball enters at the top end of the column. A shaft is rotateably mounted perpendicular to the tracks at the lower end of the floor of the tracks so that the lowest ball in each column of balls rests against the shaft. For each track, one or more curved tines extends from the shaft. As the shaft rotates, the tines scoop up the ball and discharges it into a chute which directs the balls into the users bucket. The set of tines for each track are located around the shaft in a position that is staggered with respect to the other sets of tines so that each ball is scooped up at a different time than its neighboring balls. Therefore, each ball is discharged into the chute one ball at a time thereby avoiding the problem of balls jamming in the chute such as occurs when a large number of balls are discharged into the chute simultaneously. The location of each set of tines with respect to the other tines around the shaft determines the order in which the balls are dropped into the chute. In one arrangement, the tines may be located at a constant angular displacement with respect to its neighboring tines so that a row of balls is discharged into the bucket at a uniform rate. In another arrangement, the tines may be arranged so that, e.g., two balls may drop into the chute simultaneously but the tines are at locations that are distal from one another.

In the present invention, the number of balls discharged into the chute depends on the length of time that the shaft of tines rotates each time the shaft is activated to turn. In contrast to the Knez Patent which discharges a row of balls simultaneously, as few as one ball can be dispensed by the present invention simply by limiting the angular rotation of the shaft of tines to a small fraction of a complete revolution. Another difference between the present invention and the Knez apparatus is that the L-shaped elongated bar of Knez must perform reciprocal motion with each row of balls discharged, whereas the present invention operates by continuous rotation of the shaft. Construction involving continuous rotation is inherently simpler and more economical than the Knez construction requiring reciprocal motion.

Although it is understood that a major use of the apparatus is to vend golf balls to the public such as at a driving range, it will also be understood that the principles of the invention can be applied to dispensing a variety of substantially spherical objects such as tennis balls, oranges, etc.

DESCRIPTION OF THE PREFERRED EMBODIMENT

Figure 1:
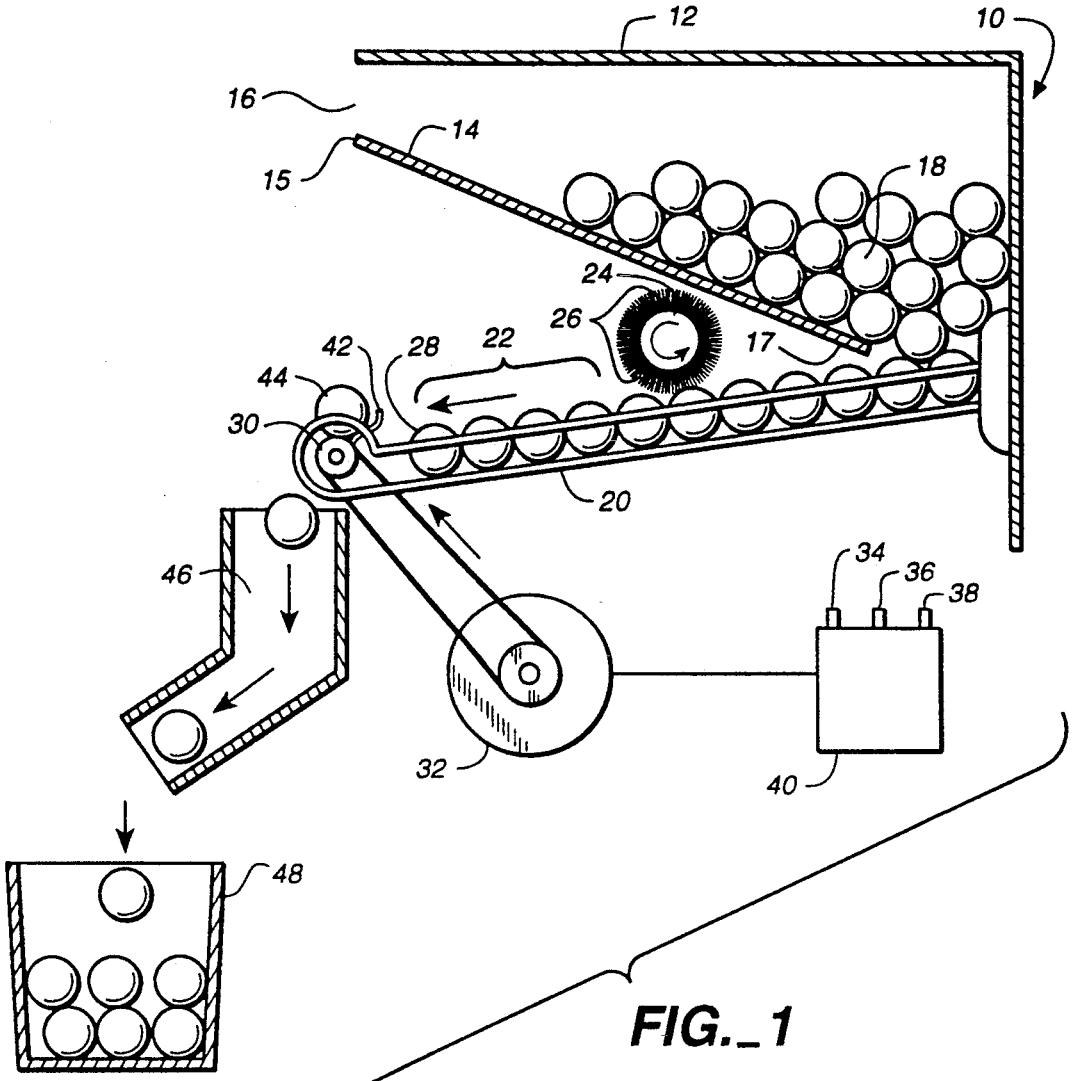
FIG. 1 shows a mechanical schematic diagram of the ball vending machine.
Figure 2:
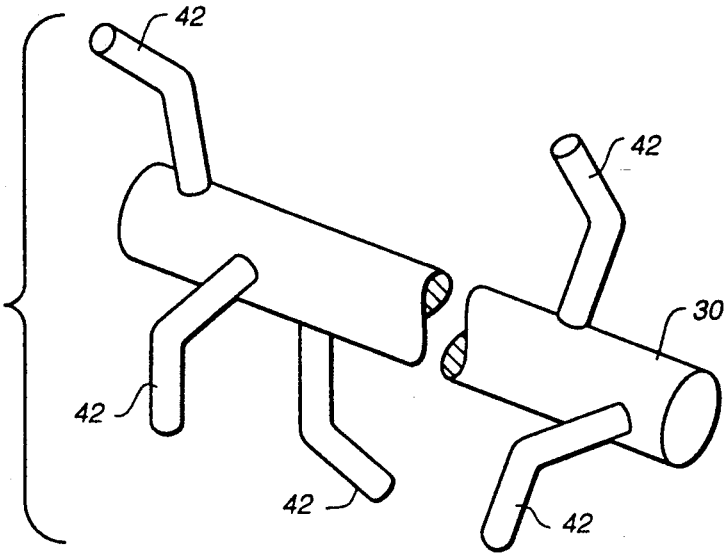
FIG. 2 is a perspective view showing the staggered tine construction of the dispensing shaft.

Turning now to a discussion of the drawings, there is shown in FIG. 1 the mechanical schematic diagram of a spherical object dispensing apparatus 10 of this invention including a housing 12 with a top inclined floor 14 with an upper edge 15 defining an entrance 16 where balls 18 are loaded into the apparatus. The objects fall from a lower edge 17 of floor 14 into one of a number of tracks 20 to form a column 22 of balls. One track 20 is shown in FIG. 1. A revolving brush 24 helps to form the column 22. The brush is flat on opposite sides 26. The lowest ball 28 rests against a revolving shaft 30 driven by motor 32. When a user insert coins into one of slots 34, 36 or 38, a timer 40 energizes motor 32 for a period of time dependent on the selection of slot 34, 36 or 38 so that a tine 42 scoops up ball 44 and drops it into chute 46 and thence into bucket 48. FIG. 2 shows that each tine 42 extending from shaft 30 is secured in a staggered location around the shaft 30 so that the balls are scooped up at separate times as the shaft 30 rotates and dropped one at a time into chute 46. The user selects the number of balls to be deposited into the bucket by selecting the slot 34, 36 or 38 (FIG. 1) or in an alternative circuit discussed below in connection with FIG. 5, by depositing one coin in slot 34 to select one quantity of balls, into slots 36 and 36' to select a second quantity of balls or into slots 38, 38' and 38'' to select a third quantity of balls.

Figure 3:
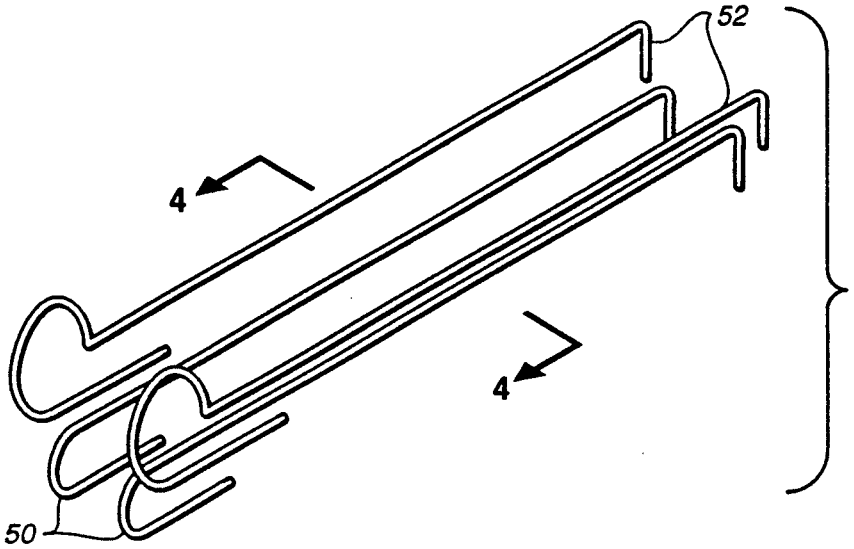
FIG. 3 is a perspective view showing the construction of a single track.
Figure 4:
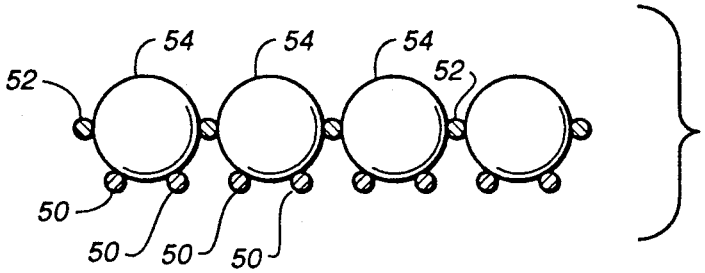
FIG. 4 is a sectional view showing the track construction of FIG. 3.

FIG. 3 shows each of the tracks 20 of this invention formed from rods. Each track includes two bottom rods and two guide rods 52. FIG. 4 is a sectional view of the rod layout taken along line of sight 4—4 in FIG. 3 showing the balls 54 rolling on bottom rods 50 and retained on the track by guide rods 52. As shown in FIGS. 3 and 1, guide rods 52 loop around shaft 30 thereby maintaining the ball in its track as the tine 42 (FIG. 2) pushes the ball around the shaft 30.

Figure 5:
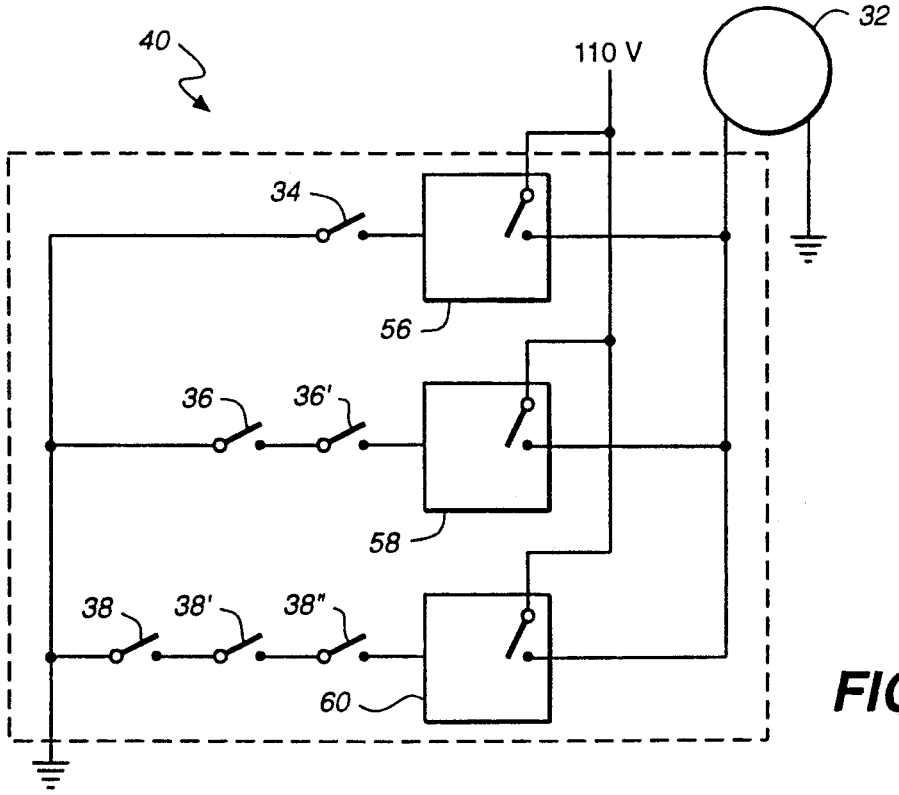
FIG. 5 is a schematic diagram of the electronic circuitry for dispensing the balls.

FIG. 5 is an electrical schematic diagram of an arrangement for activating the motor 32 to rotate shaft 30 (FIG. 1) for a selected period of tine. There are shown the coin activated switches, 34, 36, 36', 38, 38' and 38''. When one coin is inserted in switch 34, timer 56 is activated to turn on motor 32 for one period determined by the setting of timer 56. When a coin is inserted in switch 36 and another coin in switch 36', timer 58 is activated to turn on motor 32 for a longer period of time so as to discharge more balls. When a coin is inserted in switch 38, another coin in switch 38' and another coin in switch 38'', timer 60 is turned on to activate motor 26 for an even longer period so as to discharge the greatest number of balls. Time delay relays (identified as part number TMM-0999M) are manufactured by the National Controls Corporation distributed by Consolidated Parts, San Jose, Calif.

A major feature of the invention is a method for dispensing spherical objects by depositing the objects on the top ends of a row of parallel inclined tracks so as to form a column of objects in each track and scooping the lowest object from each track at a time that is different from the time that neighboring objects are scooped and continuing the scooping operation until a desired number of objects is discharged from the tracks. This arrangement makes possible a wide selection of the order in which the balls are deposited into the chute. For example, if all the tines were arranged in a straight line on the shaft, then they would all be deposited simultaneously in the chute. If the tines were all located aroound the shaft with each tine placed at a constant interval from its neighbor, then the objects would be deposited one after the other in succession. In another arrangement, two or more objects could be dropped simultaneously from positions on the shaft that are distal from one another. Any arrangement of the tines around the shaft determining the order in which the objects are dropped in an embodiment of this invention.

Variations to the embodiment described above are contemplated which are within the scope of the invention.

As noted above, the invention could be used to dispense various objects such as golf balls, tennis balls, oranges, etc. Each of these different objects could require differences in construction of the track. For example, one track construction could be a single bottom rod (in place of two bottom rods shown in FIG. 4 and two tines in place of one tine. Another track construction could be a row of troughs which might be most useful for dispensing slightly irregular spheres such as oranges. An advantage of the open construction with rods described in the preferred embodiment is that the structure is more open than, e.g., the trough construction permitting any debris to fall through the tracks without clogging the apparatus.

Variations to the circuit shown in FIG. 5 are also contemplated such as lights to indicate the status of the circuit, an independent token operated slot, a manual switch, and "sold out" switch.

Other modifications and additions could also be made within the scope of the present invention which is accordingly defined only by the following claims which are further exemplary of the invention.

What is claimed is:

1. An apparatus for dispensing substantially spherical objects into a chute, said apparatus being of the type that includes inclined tracks arranged in a row and having an upper end where said objects are loaded to form a column of objects on each track and a lower end of said tracks arranged in a straight row of lower ends wherein the improvement comprises:

a shaft, rotateably mounted parallel to and adjacent said row of lower ends;

means for rotating said shaft;

a plurality of tine means, each said tine means attached to said shaft adjacent one said lower end respectively for scooping up a lowest one of said objects in said column from said respective lower end as said shaft rotates and dropping said object into said chute; and circuit means for activating said rotating means a predetermined period of time to dispense a predetermined number of said spherical objects.

2. An apparatus as in claim 1 wherein at least one tine means is secured to said shaft at a location measured around said shaft that is different from said locations of said other tine means providing that said object scooped up by said at least one tine means will be dropped in said chute at a time that is different than said times that said other objects are dropped.

3. An apparatus as in claim 2 wherein each said location is positioned at a constant interval from neighboring tine means.

4. An apparatus for dispensing objects that are substantially spherical which comprises:

a plurality of parallel inclined track means arranged in a row; each track means having an upper end and an end arranged in a straight horizontal row of lower ends;

means located at said upper end for continuously loading said objects onto said track means such that a column of said spherical objects is supported on each said track means extending from said upper track end to said lower track end;

a shaft, rotatably mounted parallel to and adjacent said row of lower ends;

means for rotating said shaft;

a chute;

a plurality of tine means, each said tine means attached to said shaft adjacent one said lower end respectively for scooping up a lowest one of said objects from said respective lower end as said shaft rotates and dropping said object into said chute; and circuit means for activating said rotating means a predetermined period of time to dispense a predetermined number of said spherical objects.

5. An apparatus as in claim 4. wherein at least one said tine means extends from said shaft at a location measured around said shaft that is staggered around said shaft with respect to locations of said other tine means providing that said object scooped up by said at least one tine means will be dropped in said chute at a time that is different than said times that said other objects are dropped.

6. An apparatus as in claim 4 wherein said rotating means comprises a motor coupled to said shaft.

7. An apparatus as in claim (7) 6 wherein said circuit means comprises a coin activated switch.

8. An apparatus as in claim (9) 4 wherein (said) a selecting means for said circuit means comprises a plurality of coin activated switches.

9. An apparatus as in claim 4 wherein each said track means comprises a set of rods, arranged as an open trough, with at least one bottom rod forming a bottom of said trough for supporting said objects and a pair of side rods, one rod on one side of said object respectively for maintaining said object on said track.

10. An apparatus as in claim 9 wherein each said side rod has an end that loops around said shaft such as to continuously maintain said object in contact with said tine as said shaft rotates and drops said object into said chute.

11. An apparatus as in claim 4 wherein said loading means comprises:

a housing with an opening;

a top inclined floor in said housing with an upper edge adjacent said opening and a lower edge adjacent said upper ends of said tracks.

* * * * *